US009809764B2

(12) United States Patent
Umansky et al.

(10) Patent No.: US 9,809,764 B2
(45) Date of Patent: Nov. 7, 2017

(54) HYDROCRACKING PROCESS FOR HIGH YIELDS OF HIGH QUALITY LUBE PRODUCTS

(71) Applicant: ExxonMobil Research and Engineering Company, Annandale, NJ (US)

(72) Inventors: Benjamin S. Umansky, Fairfax, VA (US); Teck-Mui Hoo, Centreville, VA (US); Richard A. Demmin, Highland Park, NJ (US); Fengrong Chen, Spring, TX (US); James W. Gleeson, Magnolia, TX (US); Suisheng M. Dou, The Woodlands, TX (US); Tomas R. Melli, The Woodlands, TX (US); Michael C. Clark, Montgomery, TX (US)

(73) Assignee: EXXONMOBIL RESEARCH AND ENGINEERING COMPANY, Annandale, NJ (US)

( * ) Notice: Subject to any disclaimer, the term of this patent is extended or adjusted under 35 U.S.C. 154(b) by 0 days.

(21) Appl. No.: 15/066,251

(22) Filed: Mar. 10, 2016

(65) Prior Publication Data

US 2016/0298038 A1 Oct. 13, 2016

Related U.S. Application Data

(60) Provisional application No. 62/136,692, filed on Mar. 23, 2015.

(51) Int. Cl.

| | |
|---|---|
| ***C10G 47/12*** | (2006.01) |
| ***C10G 47/16*** | (2006.01) |
| ***C10G 67/02*** | (2006.01) |
| ***C10G 47/14*** | (2006.01) |
| ***C10G 65/12*** | (2006.01) |
| ***C10M 101/02*** | (2006.01) |

(52) U.S. Cl.

CPC ..... *C10G 67/02* (2013.01); *C10G 47/14* (2013.01); *C10G 47/16* (2013.01); *C10G 65/12* (2013.01); *C10M 101/02* (2013.01); *C10G 2300/301* (2013.01); *C10G 2300/302* (2013.01); *C10G 2300/304* (2013.01); *C10G 2400/10* (2013.01)

(58) Field of Classification Search

CPC .. C10G 47/12; C10G 47/16; C10G 2300/304; C10G 2400/10

See application file for complete search history.

(56) References Cited

U.S. PATENT DOCUMENTS

| | | | | |
|---|---|---|---|---|
| 3,506,565 | A | 4/1970 | White et al. | |
| 3,728,249 | A | 4/1973 | Antezana et al. | |
| 4,011,154 | A | 3/1977 | Stangeland et al. | |
| 4,082,647 | A | 4/1978 | Hutchings et al. | |
| 5,364,514 | A | 11/1994 | Sanborn et al. | |
| 5,580,442 | A | 12/1996 | Kwon et al. | |
| 5,904,835 | A | 5/1999 | Thakkar | |
| 5,985,132 | A | 11/1999 | Hoehn et al. | |
| 6,299,759 | B1 | 10/2001 | Bradway et al. | |
| 6,623,623 | B2 | 9/2003 | Kalnes | |
| 6,623,624 | B2 | 9/2003 | Cash et al. | |
| 6,656,342 | B2 | 12/2003 | Smith et al. | |
| 6,726,832 | B1 | 4/2004 | Baldassari et al. | |
| 6,783,660 | B2 | 8/2004 | Dahlberg et al. | |
| 7,156,977 | B2 | 1/2007 | Wrisberg et al. | |
| 7,238,275 | B2 | 7/2007 | Stupin et al. | |
| 7,547,386 | B1 | 6/2009 | Thakkar et al. | |
| 8,691,082 | B2 | 4/2014 | Petri et al. | |
| 2005/0183988 | A1* | 8/2005 | Freerks ..... | C10G 65/00 208/92 |
| 2012/0004478 | A1 | 1/2012 | Umansky et al. | |
| 2013/0048536 | A1 | 2/2013 | Noh et al. | |
| 2014/0262941 | A1 | 9/2014 | Ramaseshan et al. | |
| 2015/0027925 | A1 | 1/2015 | Joseck et al. | |

OTHER PUBLICATIONS

S. T. Sie, Acid-Catalyzed Cracking of Paraffinic Hydrocarbons, 31 Ind. Eng. Chem. Res. 1881-1889 (1992).*

The International Search Report and Written Opinion of PCT/US2016/021756 dated Jun. 6, 2016.

* cited by examiner

*Primary Examiner* — Randy Boyer

(74) *Attorney, Agent, or Firm* — Scott F. Yarnell; Robert A. Migliorini

(57) ABSTRACT

A process for producing high yields of higher quality (API Group II, Group III') lubricating oil basestock fractions which allows the production of two or more types of high quality lubes in continuous mode (no blocked operation mode) without transition times and feed or intermediate product tankage segregation. Two consecutive hydroprocessing steps are used: the first step processes a wide cut feed at a severity needed to match heavy oil lube properties. The second step hydroprocesses a light oil after fractionation of the liquid product from the first step at a severity higher than for the heavy oil fraction. The two hydroprocessing steps will normally be carried out in separate reactors but they may be combined in a single reactor which allows for the two fractions to be processed with different degrees of severity.

16 Claims, 5 Drawing Sheets

HYDROCRACKING PROCESS FOR HIGH YIELDS OF HIGH QUALITY LUBE PRODUCTS

CROSS-REFERENCE TO RELATED APPLICATIONS

This application claims priority to U.S. Provisional Application Ser. No. 62/136,692 filed Mar. 23, 2015, which is herein incorporated by reference in its entirety.

FIELD

The present disclosure relates to a process for converting heavy hydrocarbon oils into high quality lubes with the concomitant production of distillate fuels by hydrocracking with other associated process steps.

BACKGROUND

Current trends in the supply and prices of petroleum crudes are driving refining processes to use poorer quality crude oils to produce lubricating oil basestocks. High quality lubricating oils must have a high viscosity index (VI), low volatility, good low temperature fluidity and high stability. These requirements, in turn, are being pushed by the requirements of modern engine design which, in its own turn, is being driven by regulatory and economic pressures for ever higher efficiencies at an unprecedented pace. The demands on lube supply are increasingly being met by hydrocracking, the process originally applied predominantly to fuels manufacture but now being applied to lube basestock production with distillate fractions of lower boiling range being produced at the same time as valuable fuel products.

The trends in lube quality are reflected in the increasing proportions of the higher quality lube basestocks coming from the refineries, as measured by the outputs of the various API Groups. The solvent-refined Group I base oils contain less than 90 percent saturates, greater than 0.03 percent sulfur and have a viscosity-index range of 80 to 120. Group II base oils are often manufactured by hydrocracking and are defined as being more than 90 percent saturates, less than 0.03 percent sulfur and with a viscosity index of 80 to 120. Group II base oils have better antioxidation properties, a clearer color and cost more in comparison to Group I base oils. Group III oils contain more than 90 percent saturates, less than 0.03 percent sulfur and have a viscosity index over 120. In comparison to a little more than a decade ago API Group II base oils now constitute up to 47 percent of the capacity of plants compared to 21 percent for both Group II and III base oils a decade ago. Although Group III plant capacity is currently limited, it is expected to rise with time. At the same time Group I base oils previously made up 56 percent of the capacity, compared to 28 percent of the capacity in today's plants.

Conventional methods for producing both fuels and lubricating oil products from a single integrated hydrocracking system are typically optimized for one type of product, with the properties and yield of the second type of product being dictated by conditions imposed on the system. For example, a fuels hydrocracker, operated at high severity for producing fuels, may also produce a lubricating oil product stream from the unconverted high boiling fractions although the range of lubricating oil fractions from a single unit may be limited. In addition, fuels hydrocrackers are typically operated with high recycle ratios in order to increase the yield of the desired fuel products—mainly middle distillates such as road diesel and aviation kerosene—so that the yield of higher boiling lube fractions is limited. The repeated passes through the unit occurring with the high recycle ratios are likely to result in excessive conversion to lower boiling products and may possibly degrade performance indicia as lube basestocks. Accordingly, it would be desirable to develop processes for producing high quality lubricant basestock fractions by the hydrocracking process.

Hydrocracking of vacuum gas oils and heavier feeds to produce lube oil fractions is typically restricted to operation at low conversion in order to produce base stocks over a specific viscosity range. This usually implies that the higher boiling product fractions contain high concentrations of cyclic (naphthenic and even untreated aromatic) components. Removal of the these components by hydroprocessing requires high temperatures and pressures which lead to the consumption of large amounts of hydrogen during the processing as the ring structures are opened and hydrogenated.

Traditionally, two different types of lube products requiring different processing severities for their production have been made in blocked operation in order to preserve optimal lube yields. The blocked operation is done in steps, first one lube grade is produced and then the other. The plant is used to produced one lube grade at a time and for this reason, operating conditions of the reactor(s) can be adjusted to get the highest yield at a given quality. One of the problems of blocked operation is that the feed needs to be segregated for each type of lubricant product so it needs a distillation step and tankage to store the different feeds. In addition, there are transition times between the blocks in which the process needs to reach steady state for production of a consistent uniform product quality.

Another way of making two or more lube grades is to process a wide cut feed in one set of reactors targeting one key specification, then fractionating to produce the two or more lube grades. This process is results in yields which are less than optimal with a give-away in product yields and qualities such as VI, viscosity, cold flow properties.

Various proposals have been made for the production of lube fractions from heavy oils by hydrocracking high boiling fractions. U.S. Pat. No. 5,580,442 (Kwon et al) discloses a process in which a vacuum gas oil (VGO) is hydrotreated to remove impurities and then hydrocracked. The light hydrocarbons created by cracking are then removed by distillation and a lube boiling range fraction is separated from the unconverted bottoms fraction.

U.S. Pat. No. 5,985,132 (Hoehn) discloses a method using a lubes hydrocracker at a low conversion with the a second hydrocracking step to produce fuels.

U.S. Pat. No. 6,623,624 (Cash) discloses a hydrocracking process for producing fuels asserting the flexibility to recover one or more lubricating oil products over a range of viscosities and viscosity indices. The process functions by hydroprocessing the feed at either hydrotreating or hydrocracking conditions to remove impurities and separating the liquid fraction effluent by boiling point range to yield a lubricating oil product as well as a fuel product and a bottom fraction. The bottom fraction is passed to a hydrocracking step to yield a product which can be fractionated into overhead and a recycle stream which is sent back to the hydrocracking for fuels production.

US 2014262941 (Rameseshan) discloses a process for producing multiple grades of lube oil base feedstock in a two-stage hydrocracking unit. Effluent from the first hydrocracking step is sent to a separation zone with a heavy liquid effluent being fractionated off. A portion of the bottom stream from the fractionator is passed to a second hydrocracking step form which the effluent is fractionated to produce a second lube boiling range fraction.

SUMMARY

We have now developed a process for producing high yields of higher quality (API Group II, Group III, GII/GIII) lubricating oil basestock fractions with middle distillate fuels produced as by-products.

The process configuration allows the production of two or more types of high quality lubes in continuous mode (no blocked operation mode) with similar or higher yields than the blocked operation mode typical of current commercial lube units. In this continuous mode, the process does not require transition times and feed or intermediate product tankage segregation.

Two consecutive hydroprocessing steps are required, the first step will process the wide cut feed, operating at a severity needed to match the HO lube properties. The second step will hydroprocess the LO after fractionation of the liquid product from the first step with the operating severity of the second reactor e.g. (temperature, space velocity, catalyst activity) higher than the HO reactor. The two hydroprocessing steps will normally be carried out in separate reactors but they may be combined in a single reactor which allows for the two fractions (HO, LO) to be processed with different degrees of severity.

According to the present disclosure, the lube boiling range fractions may be produced in a process unit with two hydrocracking reactors with similar or different loading configurations but operating at different operating conditions. For example, the operating pressures and/or temperatures could be the same or different for the two reactors. The operating conditions used in the first hydrocracking reactor target the specifications of the heavy oil (HO) product(s) while the second hydrocracking reactor targets the specifications of the light oil (LO) product(s). The feed for the first hydrocracking reactor is a wide cut feed which provides a hydrocrackate with a boiling range suitable for both light oil and heavy oil lube products. This hydrocracked effluent from the first reactor is then fractionated to separate the light oil product(s) that will be hydroprocessed in the second hydrocracker. Light ends, naphtha and distillate products from the hydrocracker are also separated out at this point. The higher boiling stream will be sent for further processing to match heavy oil product specifications, e.g. aromatics, cold flow properties, without significant boiling range conversion. The light oil portion is then passed to the second hydrocracker to provide the light oil (LO) feed for the second hydrocracking reactor. The lube yields obtained with this hydrocracking configuration matches or improves the lube yields obtained in blocked operation mode since each hydrocracking reactor severity is adjusted to each type of lube products (HO and LO) The effluents from both hydrocrackers are processed such as by hydrodewaxing and/or hydrofinishing to provide the finished light oil and heavy oil lube product properties. The finishing steps following the hydrocracking may be carried out in separate finishing units or, more preferably, in a common unit processing both the hydrocracked light oil and the hydrocracked heavy oil and the finished products separated in a common fractionator.

The hydrocracking conditions of the first hydrocracking step are selected so that the hydrocrackate is provided with the lube quality specifications required for the finished heavy oil lube fraction with the maximum yield attainable. Similarly, the hydrocracking conditions of the second hydrocracking step are selected to provide a hydrocrackate meeting the lube quality specifications required for the finished light oil lube fraction with the maximum yield attainable for that lube fraction.

A preferred unit configuration uses a divided wall fractionator to separate the products from the first hydrocracker and from the finishing section(s).

The hydrocracked light and heavy oil fractions are preferably processed together in a common finishing section, for example, through hydrodewaxing and hydrofinishing reactors. In these two reactors the wax and aromatic content are targeted for correction. This common finishing configuration can feed into the same single fractionation system used to carry out the initial boiling point separation of the first hydrocracker effluent using dividing wall technology. Alternatively, an independent finished product fractionation system can be used. The advantage of using a single divided wall fractionator is lower capital cost while retaining the capability to produce two or more different lube qualities with each hydrocracking reactor operated with its own loading configuration and operating conditions to meet the specific target specifications for both the light and heavy lube products.

The hydroprocessing (hydrotreating, hydrocracking and/or hydrofinishing) operations can be carried out in a unit that allows the introduction of a plurality of different feeds different bed levels in the reactor so that they pass through a different number of beds to provide the requisite degree of processing appropriate to each product specification. The number of beds, type of catalysts and operating conditions will depend on the type of feeds and the type of products that are to be produced. This reactor has feed processing flexibility characteristics: the bed at which feed is introduced can be changed according to feed type and the product types that will be produced. As a general characteristic of this reactor operation, the feeds that must be treated most severely will be introduced in the top portion of the reactor and the feeds requiring less severe treatment will be introduced in the bottom beds of the reactor. The reactor can be designed to allow the changes to which bed the feeds are introduced to the reactor; in this way, the reactor will have the capability to hydroprocess the feed to the extent required for given product specs. Bed temperature and reactor residence time will be the main variables for this type of operation. Depending on the type of feeds (e.g. straight run, cracked stocks) and the targeted product specifications, the beds can be loaded with hydrotreating, hydrocracking or hydrofinishing catalysts or combination of them.

In the operation producing light oil (LO) and heavy oil (HO) lubes products, the light oil stream normally requires the highest severity to match the LO lube product specifications and for this reason, the feed stream will be introduced in the upper portion of the reactor. The heavy oil that requires less VI uplift (less severity) will be introduced in the lower portion of the reactor; the specific bed in which the HO will be introduced will again depend on the type of feed and product specifications.

BRIEF DESCRIPTION OF THE DRAWINGS

In the accompanying drawings typical applications of the process configurations and process units in highly simplified schematics are shown as follows.

DETAILED DESCRIPTION

Figure 1:
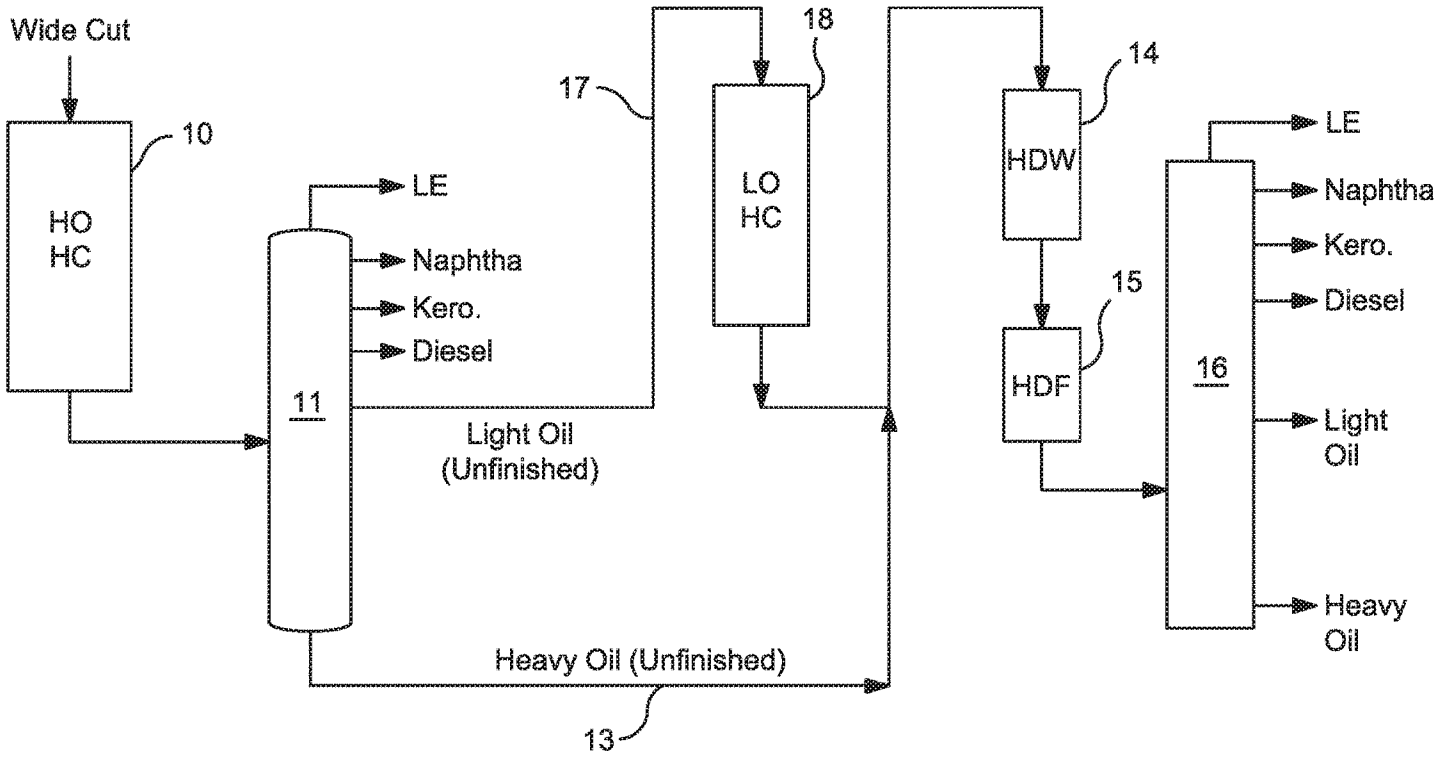
FIG. 1 shows a revamp modification a typical commercial unit for GII/GIII lube quality production with two separate hydrocrackers and separate intermediate and final fractionators.

The term "about" or "approximately" means an acceptable error for a particular value as determined by one of ordinary skill in the art, which depends in part on how the value is measured or determined. All numerical values within the detailed description and the claims herein are modified by "about" or "approximately" the indicated value, and take into account experimental error and variations that would be expected by a person having ordinary skill in the art.

Heavy Oil Feeds

The feeds used in the present process generally comprise distillable feeds boiling above about 250° C. (about 480° F.) and extending into in the gas oil boiling range above about 345° C. (about 650° F.) with end points about 500° C. (about 930° F., possibly as high as about 600° C. (about 1110° F.) or even higher depending on the acceptable levels of high boiling feed components. The feed may be, for example, a wide cut feed extending from the heavy gasoline boiling range up to the distillable limit for the production of neutral (non-residual) lube products; narrower cut feeds are also possible if consistent with the desired lube products. Typical examples of hydrocarbon feed types from refinery operations include light gas oil, heavy gas oil, vacuum gas oil, straight run gas oil and deasphalted oils. The process is also useful for upgrading oil and/or wax produced in a synthetic fuels process such as a Fischer-Tropsch. The feed may have been processed, e.g. by hydrotreating, prior to the present process to reduce or substantially eliminate its heteroatom, metal, asphaltene or aromatic content. Asphaltenes should preferably be held at less than about 500 or 200 ppm, preferably less than about 100 ppm.

An exemplary wide cut feed that may be used in the present process would be a feed as follows:

TABLE 1

| Wide Cut Feed | | |
|---|---|---|
| Hydrogen Content | wt % | 13.5 |
| Molecular Weight | /mole | 381.6 |
| Carbon Aromaticity | wt % | 7.1 |
| API Gravity | | 29.1 |
| Specific Gravity @ 60 F. | | 0.9 |
| Total Sulfur | wt % | 0.0052 |
| Total Nitrogen | ppm | 10.0 |
| Basic Nitrogen | ppm | 5.2 |
| Total Aromatics, wt % | | 21.4 |
| Total Paraffins, wt % | | 22.5 |
| Total Olefins, wt % | | 0.0 |
| Total Naphthenes, wt % | | 56.0 |
| Cetane Index D976-80 | | 43.7 |
| Cetane Index D4737 | | 63.2 |
| D2887 IBP | deg C. | 261.3 |
| D2887 5 wt % | deg C. | 322.4 |
| D2887 10 wt % | deg C. | 344.2 |
| D2887 30 wt % | deg C. | 392.1 |
| D2887 50 wt % | deg C. | 428.7 |

TABLE 1-continued

| Wide Cut Feed | | |
|---|---|---|
| D2887 70 wt % | deg C. | 466.5 |
| D2887 90 wt % | deg C. | 521.6 |
| D2887 95 wt % | deg C. | 547.4 |
| D2887 FBP | deg C. | 606.3 |

Hydroprocessing Catalysts

The hydroprocessing catalysts used in the present processing units will generally be of the conventional types with a metal function having hydrogenation/dehydrogenation activity supported on a porous, refractory metal oxide support such as alumina, silica, silica-alumina, thoria, titania, zirconia, normally with a binder material such as a clay. The metal function will promote the hydrogenation/dehydrogenation reactions which take place in the process to concert organic heteroatoms to inorganic form, to saturate ring systems and promote crackability in reactions such as hydrogenation, dehydrogenation, hydrodecyclization etc. The typical metal functions are based on transition metals, especially the Group VI and Group VIII (IUPAC) metals with particular examples being W—Mo, W—Ni, Co—Mo, Ni—Mo. Noble metals such as platinum and palladium may also be used in certain applications, especially in hydrodewaxing and hydrofinishing; base metals are normally preferred for hydrotreating and hydrocracking catalysts if only on grounds of cost. Metal oxide catalysts should be sulfided for optimal hydroprocessing activity. If hydrocracking catalysts are used in sweet service as in second stage service (low levels of heteroatom contaminants as with hydroprocessed feeds), the use of noble metal catalysts is an option.

Hydrocracking catalysts will typically include a zeolite, especially a faujasite such as zeolite Y or USY; hydrotreating catalysts used to remove impurities such as organic sulfur and nitrogen species will normally have a lesser degree of cracking activity than the hydrocracking catalysts which are intended to promote a bulk or boiling range conversion to lower boiling species of lower molecular weight; hydrotreating catalysts will often be supported on an amorphous metal oxide support with acidic zeolite functionality. Hydrodewaxing catalysts will normally include a shape-selective zeolite component for removing waxy paraffins either by shape-selective cracking or by isomerization. Zeolites such as mordenite, erionite, and beta have been used with preference given to the synthetic intermediate pore size zeolites such as ZSM-5, ZSM-11, ZSM-23, ZSM-35 and ZSM-48. The ultimate choice of catalyst will be made by the operator given experience with the type of feeds being processed, the target product specifications and yields both for lubes and fuels, and, of course, for the characteristics of the unit.

Plant Configuration

FIG. 1 shows a proposed two stage commercial configuration capable of producing GII/GIII lube quality using the correct catalyst loading and operating conditions. This configuration may also be used in revamps of an existing hydrocracking units A wide cut feed, e.g. boiling from about 230 to about 600° C. (about 450 to about 1110° F.) is introduced into the first hydrocracker 10 which is used hydroprocessed to produce a liquid effluent which can then be separated to make the low boiling light oil and the higher boiling lube products. The process objective for this unit is to adjust the characteristics of the feed to the properties values needed to match the specifications for the heavy oil product. As such, the bulk conversion in this reactor will generally be held a relatively low level, for example, not more than 30% to products of lower boiling range. This stage may have one or two (or more, less probably) reactors to hydrotreat (and partially hydrocrack) the feed. The main characteristic of first stage is that the operation is done in a sour environment, in presence of $NH_3$ and $H_2S$. The total liquid product (TLP) from the first stage then passes to a separation/fractionation system indicated as fractionator tower 11 but in the actual unit would have a high pressure separator, a low pressure separator and the fractionator itself with the hydrogen and gases ($NH_3$, $H_2S$) being removed in the separators; the hydrogen is recycle with make up as needed and the contaminant gases removed by scrubbing.

The heavy oil fraction of the desired boiling range and some specific lube properties is removed from the lower portion of the fractionator by way of line 13 leading to hydrodewaxer 14 which, in turn, passes its total effluent by way of hydrofinisher 15 to final product fractionator 16. A light oil fraction is removed higher in tower 11 at a level appropriate to the boiling range of the intended light oil product, allowing for the changes to take place in the following units. The unfinished light oil product passes by way of line 17 to light oil hydrocracker 18 where its properties, particularly boiling range, are trimmed the desired values. Light ends and recycle hydrogen can be separated prior to the hydrodewaxer if needed. The total liquid effluent from light oil hydrocracker 18 is combined with the liquid effluent from hydrocracker 11 and the combined effluents then pass to hydrodewaxer 14 and hydrofinisher 15 for control of cold flow properties and aromatic content of both light and heavy oil lube fractions. The light oil and heavy oil products are then removed from column 16 as separate fractions of differing boiling ranges; light ends, naphtha, and distillate fractions pass out higher in the column at their respective levels.

Figure 2:
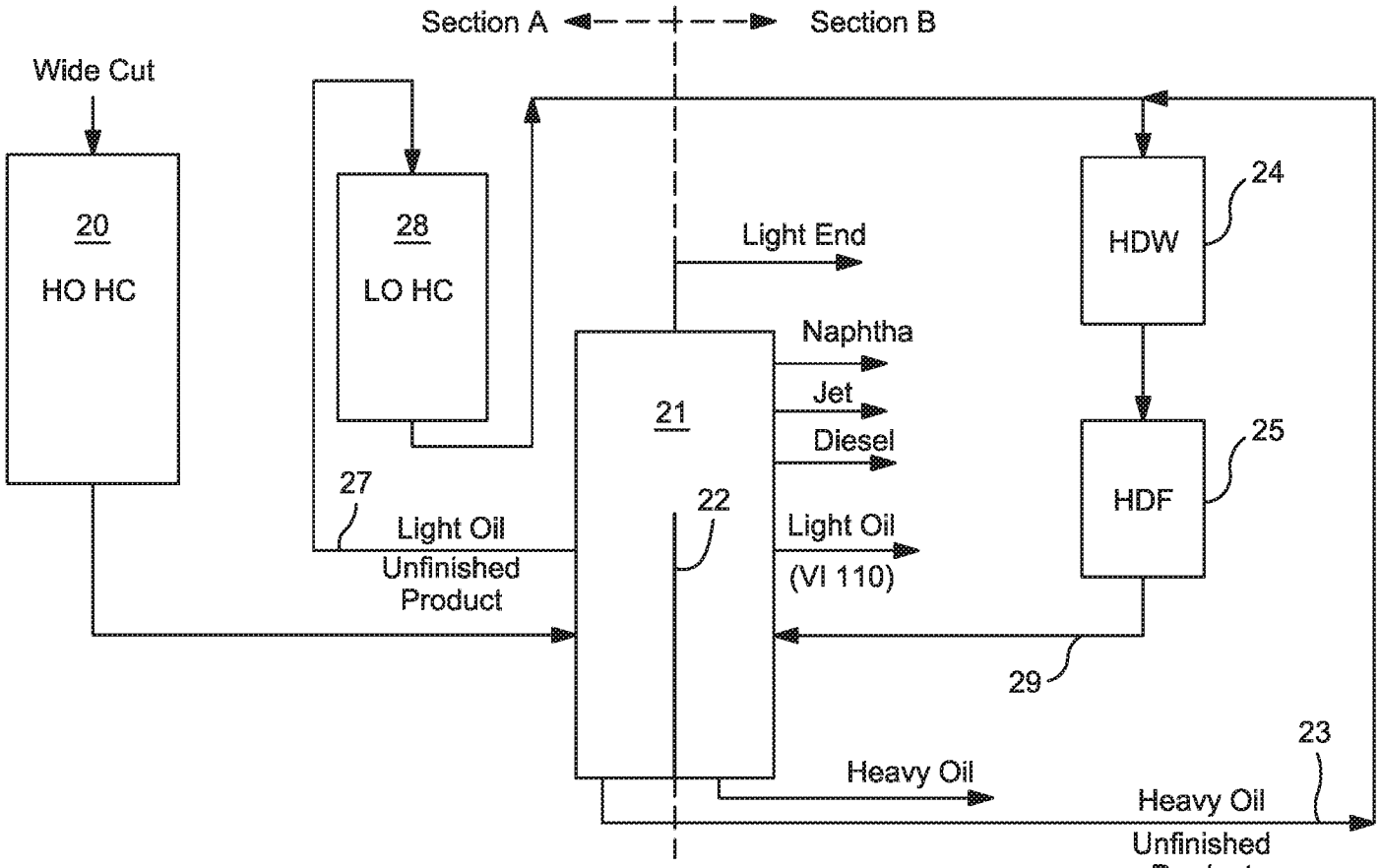
FIG. 2 shows a revamp modification with two separate hydrocrackers and a common intermediate and final fractionator for treating a hydroprocessed feed.

The variant shown in FIG. 2 with two separate hydrocrackers and a common intermediate and final fractionator is intended to process a hydroprocessed feed coming from an existing single stage hydrocracking unit. The feed for this configuration could be a hydroprocessed feed, i.e. a feed that was already hydrotreated and/or hydrocracked or a raw feed that was not hydroprocessed. The feed of FIG. 2 could hydroprocessed or could be raw feed with suitably low heteroatom/aromatics content, preferably with (no sulfur, no N, little aromatics).

This unit uses a single intermediate/final product fractionator 21 with a divided wall. The hydrocracking section of the unit is designated as Section A and the finishing section as Section B with the dividing wall of the fractionator marking the division line between the two sections. In FIG. 2, the wide cut feed e.g. boiling from about 230 to about 600° C. (about 450 to about 1110° F.) is introduced to hydrocracker 20 which is used in the same way as hydrocracker 10 to adjust the feed to the heavy oil target specifications while effecting a bulk conversion to produce an unfinished light oil feed as well as the consequential naphtha and distillate products. Fractionator tower 21 is a divided wall fractionator into which the effluent from hydrocracker 20 is fed on one side of the divided wall 22 (separators for inorganic contaminants and light ends are omitted for simplicity). The effluent from hydrocracker 10 is introduced below the top of the wall so that the portion of the effluent boiling above the temperature at wall top level remains on that side of the wall, to be removed from the bottom of the tower as the unfinished heavy oil product along line 23, passing to hydrodewaxer 24 and following hydrofinisher 25.

The unfinished light oil fraction is withdrawn from tower 21 at approximately the top of the wall and passes to light oil hydrocracker 28 by way of line 27 for the necessary conversion and then from this second hydrocracker to hydrodewaxer 24 and hydrofinisher 25. Cold flow properties of the combined lube fractions are adjusted in hydrodewaxer 24 and aromatics content in hydrofinisher 25 as in FIG. 1. The treated light and heavy oil fractions pass by way of line 29 back to fractionator 21, entering the column on the before being routed in line 29 back to column 21, entering below the top of the dividing wall so that the finished heavy oil fraction is segregated from the unfinished heavy oil fraction by the dividing wall. The finished heavy oil product is withdrawn at the bottom of the right hand side of the column and the finished light oil fraction at a higher level appropriate to its boiling range. The finished light oil fraction should be withdrawn below the top of the dividing wall to preclude contamination by components of the unfinished light oil. Light ends and converted lower boiling fractions pass out of the common section of the column above the top of the dividing wall.

Figure 3:
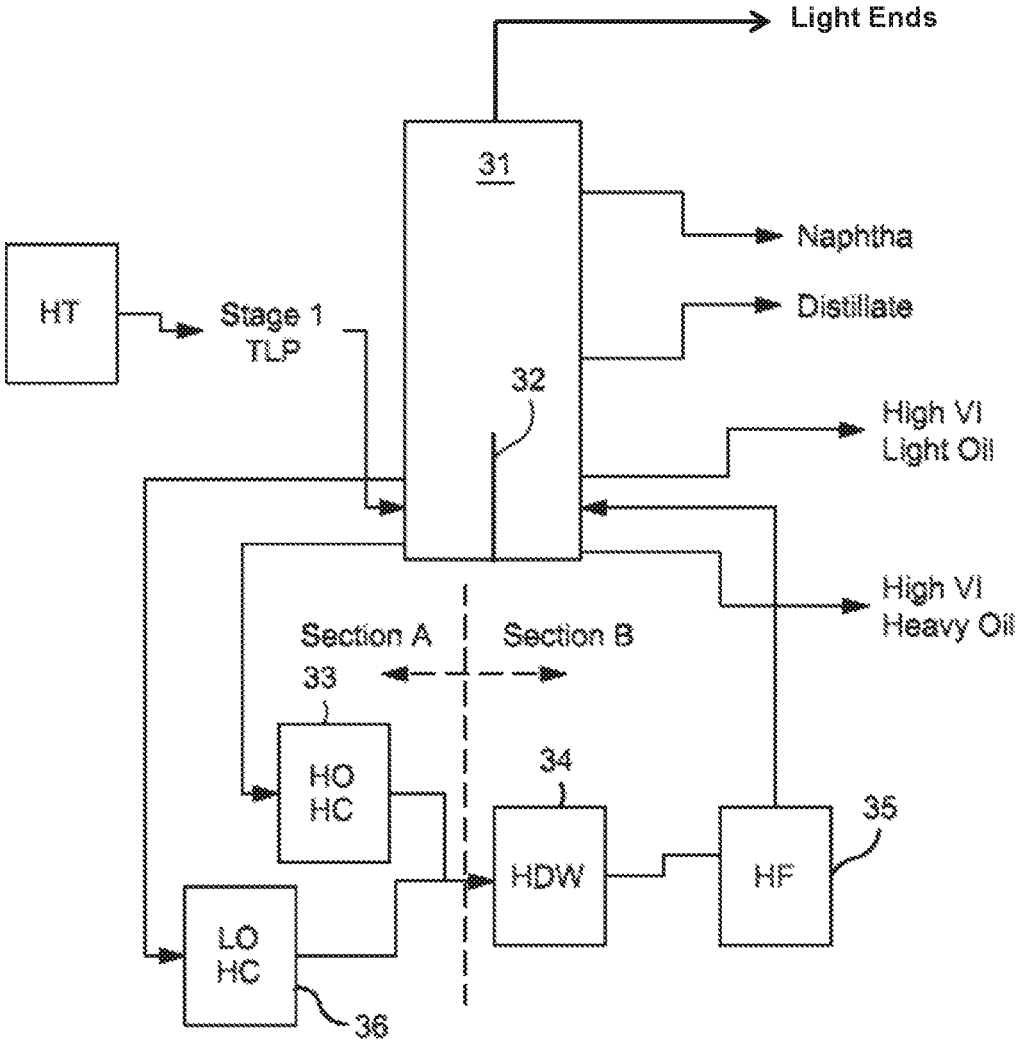
FIG. 3 shows a configuration for a grass roots unit.

FIG. 3 shows a configuration for a grass-roots unit. The heavy oil feed enters through hydrotreater HT where heteroatom contaminants are removed; product separation on the total liquid product can follow in a light ends separator (not shown) before passing to the intermediate side of the fractionator column 31 which has a dividing wall separating the intermediate side (Section A, left hand in diagram) from the finished product side (Section B, right hand in diagram). The heavy oil fraction is taken out from the bottom of the intermediate side of column 31, passing to heavy oil hydrocracker 33 where the properties are adjusted to suit those of the desired heavy lube oil product allowing for cold flow properties and aromatics treatment to be subsequently trimmed in common hydrodewaxer 34 and hydrofinisher 25. The light oil fraction is separated from the heavy oil fraction at a higher level on the intermediate side of the column appropriate to its boiling range. Light ends are removed as overhead. The light oil fraction is then taken to light oil hydrocracker 36 and from there the total liquid effluent passes to the common finishing units in Section B, hydrodewaxer 34 and hydrofinisher 35. The combined finished fractions then re-enter column 31, this time on the finished product side of the dividing wall at a level between the heavy oil and light oil withdrawal points. The finished heavy oil is taken out from the finished product side at the bottom of the column and the finished light oil product at a higher level, again preferably below the top of the dividing wall to preclude contamination.

Figure 4:
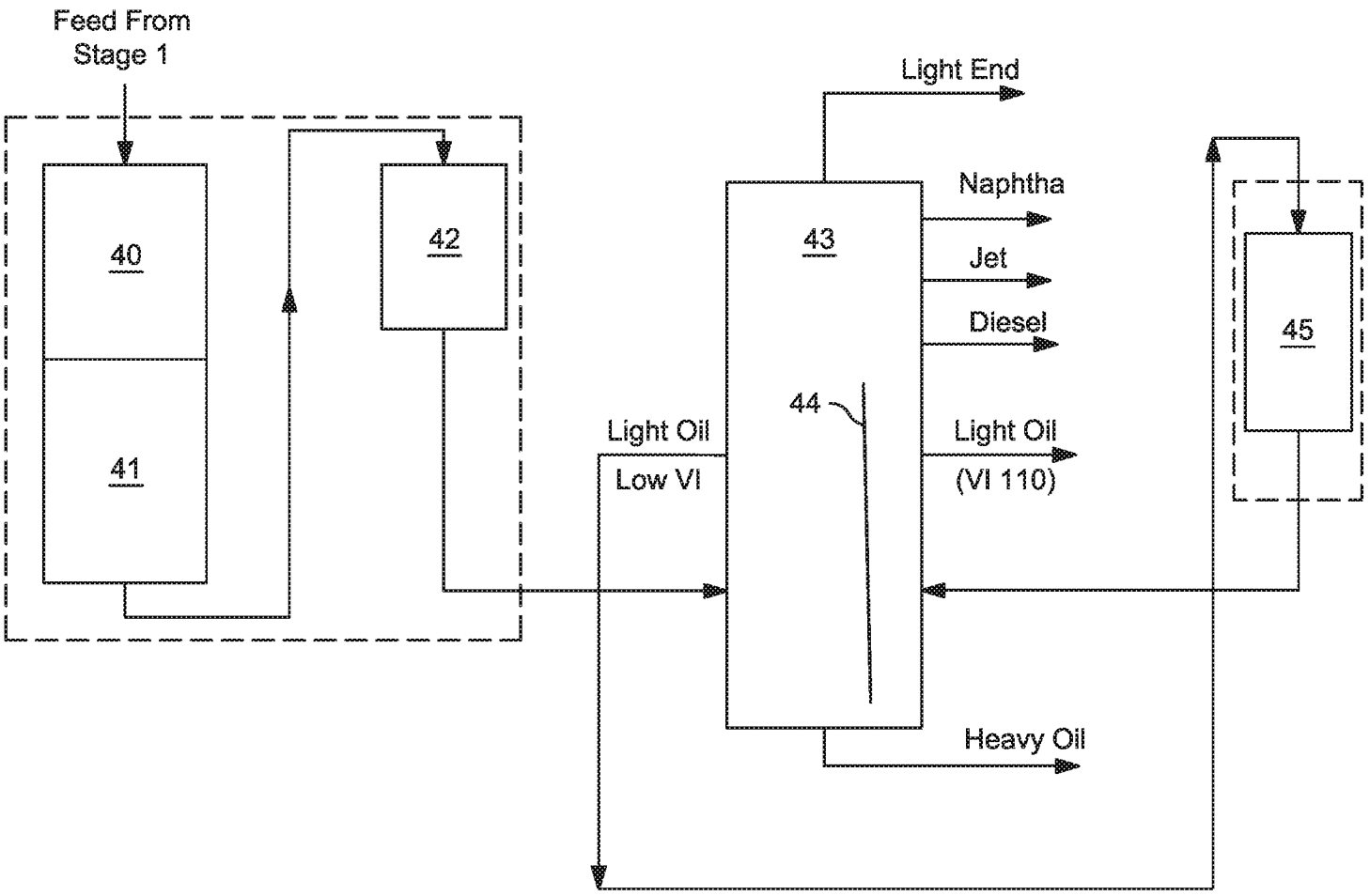
FIG. 4 shows variation of the of the configuration for treating the wide cut feed after the initial hydrocracking step.

FIG. 4 shows a unit in which the dividing wall of the fractionator is used only to separate the finished light oil from the unfinished light oil; the heavy oil is brought to specification values in the first stage hydrocracker (not shown) which provides the feed to reactor 40 which is operated as a hydrocracker or hydrotreater as appropriate depending on the degree of processing severity required to meet the heavy oil (HO) product specifications, followed by hydrodewaxer 41 and hydrofinisher 42 again to meet the HO specifications. The intermediate liquid product which at this point conforms to the requirements of the heavy oil product and preferably meets the aromatics specification of the light oil product, passes to fractionator column 43 which has dividing wall 44 located above its bottom so that the heavy oil product can be withdrawn from the common heavy oil pool at the bottom. An unfinished light oil fraction is taken off at the intermediate side of the column below the top of the dividing wall and passes to reactor or reactors 45 where hydrocracking/hydrodewaxing and hydrofinishing to meet light oil product specifications is carried out with the product effluent passing back to column 43 below the level at which the finished light oil withdrawal point. This point is again below the top of the dividing wall.

Figure 5:
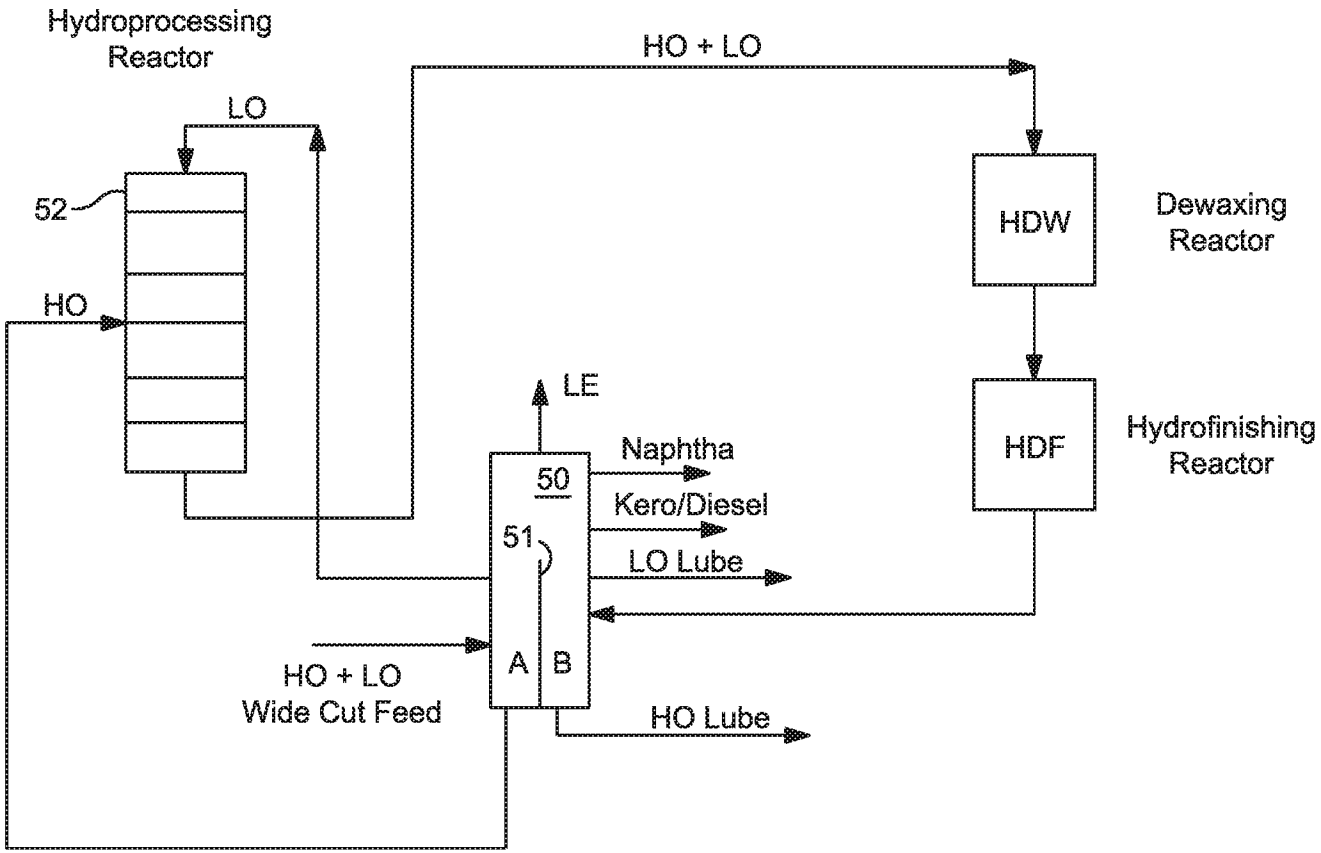
FIG. 5 shows a variation of the process unit of FIG. 2 using a hydroprocessing reactor with multiple feed inlets for handling both the light oil and heavy oil products.

FIG. 5 shows a unit which carries out the required processing of both the light and heavy oil products in a common hydroprocessing reactor with each of the products receiving the appropriate processing according to the respective feed and product properties. The reactor may be seen, depending on the varying degrees of processing severity, as a combined hydrotreating/hydrocracking reactor. This entire unit also uses a common intermediate/finished product fractionating column and in this way reduces capital cost while enabling the feed to be given the appropriate processing for each respective product.

A wide cut feed from a fractionation column or from a first stage hydroprocessing unit is sent to a divided wall fractionation column to separate the heavy oil from light oil stream. The feed enters the intermediate side of fractionating column 50 in the A Section (left hand on diagram) of the unit and is split into a heavy oil fraction and a light oil fraction. If there is diesel/kerosene/naphtha/light ends (LE) in the wide cut feed, they will be separated out and exit the common section of the column above the top of the dividing wall. The portion of the feed suitable for making the light oil fraction is taken off at a higher level than the heavy oil portion and below the top of dividing wall 51. Assuming that the light oil stream requires the highest severity to match the product specifications (e.g. a demanding VI requirement) and for this reason, this stream will be introduced into the top portion of the hydroprocessing reactor, e.g. at bed 1 (numbering from top to bottom). The heavy oil that requires less VI uplift (lower severity processing) will be introduced in the bottom portion of the reactor (e.g. at the inlet of bed 4 in the illustrated 6-bed reactor); the bed level at which the HO stream will be introduced will depend on the type of feed and product specifications.

Depending on the type of feeds (straight run, cracked stocks) and the targeted product specifications for both lube products, the beds can be loaded with hydrotreating or hydrocracking catalyst or combination of both and conditions in each bed may be varied consistent with unit operating possibilities, e.g. extent to which bed temperature can be varied by interbed quench or by external heating/cooling loops. Optionally, the stream introduced lower in the hydroprocessing reactor, shown as HO in the Figure, can be used to adjust the temperature of the lower beds. As this stream is typically at a higher temperature than the LO stream it will normally introduce heat into the lower beds in the reactor but if further temperature adjustment is required, a heat exchanger may be interposed between A in the fractionator and the hydroprocessing reactor.

The total liquid effluent from reactor 52 is taken to common hydrodewaxer 53 and hydrofinisher 54 and then re-enters the product side of the fractionating column 50 at a level intermediate the heavy and light oil product levels. Light ends and converted fractions pass out at higher levels.

This scheme allows a cost savings in fractionation equipment if a single fractionator with a divided wall replaces one that would otherwise be installed after a hydrotreating step and before the hydroprocessing reactor and another that fractionates the final products after the hydrofinishing reactor. This configuration also allows the unit to maximize the HO and LO yields similar to or better than commercial units operating a blocked operation mode.

This configuration allows maximum flexibility for production of different type of lube products using only one hydroprocessing reactor. It will allow tuning the hydroprocessing reactor operation for different type of products by changing the severity of the operation: changing bed temperature and residence time (LHSV—bed feed introduction). Since the HO feed streams have high VI most of the time, it possible that only hydrotreating catalyst with minimum hydrocracking catalyst may be needed to meet the HO lube product quality targets (e.g., API Group II/Group III). The reactor configuration and the right operating conditions will allow the production of the highest HO lube yield while avoiding overcracking of the feed. By not overcracking, the heavy feed preserves HO yield and reduces the amount of cracked oil that can degrade the VI or saturates content of the LO. For example, this is the approximate distribution of aromatics in a commercial hydroprocessed heavy neutral lube product, after distilling into 5 approximately equal fractions according to boiling point:

| | 0-20% | 20-40% | 40-60% | 60-80% | 80-100% |
|---|---|---|---|---|---|
| Approx wt % aromatics | 5.2 | 4.9 | 4.3 | 3.8 | 3.3 |

This configuration also represents the lowest capital investment since it utilizes only one hydroprocessing reactor and optionally only one fractionator.

The improvement in product yields of which the configuration of FIG. 2 is capable is demonstrated by the results of a simulation which compared the performance of a conventional lubes hydrocracker (hydrocracker/hydrotreater, followed in sequence by hydrodewaxer and hydrofinisher) with a unit conforming to FIG. 2 and using the same hydroprocessing (hydrotreating/hydrocracking/hydrodewaxing/hydrofinishing processes and catalysts) is shown in Table 2 below. The simulation compared the conventional case of a feed containing unfinished light oil and heavy oil fractions (as with the unfinished LO and HO streams of FIG. 1) passing to a single hydrocracker versus a configuration using the same feed but with the heavy oil stream passing only through the first hydroprocessing reactor (comparable to reactor 20 in FIG. 2) and the unfinished light oil stream passing to the light oil reactor (comparable to reactor 28 in FIG. 2). The loading catalyst configuration and catalyst volume were same in both cases, the only difference is that the all the catalyst was in the single reactor in the conventional case and the same amount and type of catalyst were distributed between the two reactors in the FIG. 2 case.

TABLE 2

| | | Configurations | |
|---|---|---|---|
| YIELDS | Units | Cnvntl. Run #1 | FIG. 2. Run #2 |
| H2 Cons | scm/m3 liq feed | 67.9 | 60.9 |
| Delta H2 Consumption | scm/m3 liq feed | 7.0 | |
| Hydrogen | Wt % produced | 0.7 | 0.6 |
| Water | Wt % liq feed | 0.0 | 0.0 |
| Hydrogen Sulfide | Wt % produced | 0.0 | 0.0 |
| Ammonia | Wt % produced | 0.0 | 0.0 |
| Methane | Wt % produced | 0.1 | 0.1 |
| Ethane | Wt % produced | 0.0 | 0.0 |
| Propane | Wt % produced | 0.1 | 0.1 |
| i-C4 | Wt % liq feed | 0.2 | 0.2 |
| n-C4 | Wt % liq feed | 0.2 | 0.2 |
| Light Naphtha | Wt % liq feed | 6.7 | 5.6 |

TABLE 2-continued

| YIELDS | Units | Configurations Cnvntl. Run #1 | FIG. 2. Run #2 |
|---|---|---|---|
| jet | Wt % liq feed | 25.9 | 24.2 |
| diesel | Wt % liq feed | 28.1 | 28.1 |
| Light Oil | Wt % liq feed | 24.6 | 25.2 |
| Heavy Oil | Wt % liq feed | 14.8 | 17.0 |
| Conv., 650 F.+, wt % | Wt % conv | 25.4 | 21.7 |
| Conv., 700 F.+, wt % | Wt % conv | 28.3 | 23.7 |

Further optimization with the type of catalyst and volume of catalyst in both reactors for the FIG. 2 case would be reasonably expected to increase even more the lube yields, reduce light ends, extend cycle length, etc.

In a first embodiment at least two lube boiling range fractions including a light oil lube fraction and a heavy oil lube fraction, are produced by hydrocracking a hydrocarbon feed in a first hydrocracking step under a first hydrocracking regime to provide a hydrocrackate with a boiling range suitable for the heavy oil fraction, the hydrocrackate is fractionated to separate at least a first portion for the light oil fraction and a second portion for the heavy oil fraction; and the light oil fraction is then processed in a second hydrocracking step under a second hydrocracking regime to form a second light oil hydrocrackate; the hydrocrackates are then combined and processed to meet product specifications for the light oil lube fraction and the heavy oil lube fraction; finally, the combined stream is fractionated to separate the finished light oil lube fraction and the finished heavy oil lube fraction.

In a second embodiment, the hydrocracking conditions of the first hydrocracking step provide a hydrocrackate with lube quality specifications required for the finished heavy oil lube fraction.

In a third embodiment, the hydrocracking conditions of the first hydrocracking step provide a hydrocrackate in the maximum yield meeting the lube quality specifications required for the finished heavy oil lube fraction.

In a fourth embodiment, the hydrocracking conditions of the second hydrocracking step provide a hydrocrackate with lube quality specifications required for the finished light oil lube fraction.

In a fifth embodiment, the hydrocracking conditions of the second hydrocracking step provide a hydrocrackate in the maximum yield meeting the lube quality specifications required for the finished light oil lube fraction.

In a sixth embodiment the first and second hydrocracking regimes are carried out respectively in a two hydrocrackers.

In a seventh embodiment the first hydrocracking regime provides a hydrocrackate with a boiling range suitable for both lube oil fractions.

In a eighth embodiment the two hydrocracking steps are carried out in a common hydroprocessing reactor containing a plurality of beds in sequence with the light oil fraction and the heavy oil fraction being introduced at different points in the sequence.

In a ninth embodiment the light oil fraction is introduced into the bed sequence of a multiple bed common hydroprocessing reactor before the second portion for the heavy oil fraction.

In an tenth embodiment the hydrocracking steps are carried out in the presence of hydrocracking catalysts comprising a metal function having hydrogenation/dehydrogenation activity supported on a porous, refractory metal oxide support.

In a eleventh embodiment the first hydrocracking step is carried out under sour service conditions in the presence of a hydrocracking catalyst comprising a base metal function of Group VI and Group VIII (IUPAC) metals.

In a twelfth embodiment the first hydrocracking step is carried out in the presence of a hydrocracking catalyst comprising a sulfided base metal function of Group VI and Group VIII (IUPAC) metals.

In an thirteenth embodiment the porous, refractory metal oxide supports of the first and second hydrocracking catalysts comprise alumina, silica or silica-alumina.

In a fourteenth embodiment the first and second hydrocracking steps are carried out in the presence of hydrocracking catalysts comprising a faujasite.

In a fifteenth embodiment the first and second hydrocracking steps are carried out in the presence of hydrocracking catalysts comprising zeolite Y or zeolite USY.

In a sixteenth embodiment the process is operated as a continuous process with no intermediate product tankage.

In a seventeenth embodiment the process is operated as a non-blocked continuous process.

In an eighteenth embodiment the first hydrocrackate and the combined stream are fractionated to form the finished light oil lube fraction and the finished heavy oil lube fraction in a common divided wall fractionator.

In a nineteenth embodiment the first hydrocrackate is separated into the first portion for the light oil fraction and the second portion for the heavy oil fraction in one section of the divided wall fractionator on one side of the divided wall and the combined stream is fractionated on the other side of the divided wall.

What is claimed is:

1. A process for producing at least two lube boiling range fractions including a light oil lube fraction and a heavy oil lube fraction, which comprises:

hydrocracking a hydrocarbon feed in a first hydrocracking step under a first hydrocracking regime to provide a hydrocrackate with a boiling range suitable for a heavy oil fraction, fractionating the hydrocrackate to separate at least a first portion for a light oil fraction and a second portion for the heavy oil fraction;

hydrocracking the portion for the light oil fraction in a second hydrocracking step under a second hydrocracking regime, in which the first hydrocracking step and the second hydrocracking step are carried out in a common hydroprocessing reactor containing a plurality of beds in sequence, the first portion for the light oil fraction and the second portion for the heavy oil fraction being introduced at different points in the sequence, to form a second light oil hydrocrackate with a boiling range suitable for the light oil fraction, combining the hydrocrackate portion for the heavy oil and the second light oil hydrocrackate to form a combined hydrocrackate, processing the combined hydrocrackate to meet product specifications for the light oil lube fraction and the heavy oil lube fraction and form a combined stream of a finished light oil lube fraction and a finished heavy oil lube fraction, and fractionating the combined stream to separate the finished light oil lube fraction and the finished heavy oil lube fraction.

2. A process according to claim 1 in which the first hydrocracking regime of the first hydrocracking step provide a hydrocrackate with lube quality specifications comprising aromatics and cold flow properties required for the finished heavy oil lube fraction.

3. A process according to claim 1 in which the second hydrocracking regime of the second hydrocracking step provide a hydrocrackate with lube quality specifications comprising aromatics and cold flow properties required for the finished light oil lube fraction.

4. A process according to claim 1 in which the first hydrocracking step and the second hydrocracking step are carried out respectively in a first hydrocracker and a second hydrocracker.

5. A process according to claim 1 in which the first hydrocracking step provides a hydrocrackate with a boiling range suitable for both lube oil fractions.

6. A process according to claim 1 in which the first portion for the light oil fraction is introduced into the sequence before the second portion for the heavy oil fraction.

7. A process according to claim 1 in which the first and second hydrocracking steps are carried out in the presence of hydrocracking catalysts comprising a metal function having hydrogenation/dehydrogenation activity supported on a porous, refractory metal oxide support.

8. A process according to claim 7 in which the first hydrocracking step is carried out in the presence of hydrocracking catalyst comprising a base metal function of Group VI and Group VIII (IUPAC) metals.

9. A process according to claim 7 in which the first hydrocracking step is carried out in the presence of hydrocracking catalyst comprising a sulfided base metal function of Group VI and Group VIII (IUPAC) metals.

10. A process according to claim 7 in which the porous, refractory metal oxide supports of the first and second hydrocracking steps comprise alumina, silica or silica-alumina.

11. A process according to claim 7 in which the first and second hydrocracking steps are carried out in the presence of hydrocracking catalysts comprising a faujasite.

12. A process according to claim 7 in which the first and second hydrocracking steps are carried out in the presence of hydrocracking catalysts comprising zeolite Y or zeolite USY.

13. A process according to claim 1 operated as a continuous process with no intermediate product tankage.

14. A process according to claim 1 operated as a non-blocked continuous process.

15. A process for producing at least two lube boiling range fractions including a light oil lube fraction and a heavy oil lube fraction, which comprises:

hydrocracking a hydrocarbon feed in a first hydrocracking step under a first hydrocracking regime to provide a first hydrocrackate with a boiling range suitable for a heavy oil fraction, fractionating the hydrocrackate to separate at least a first portion for a light oil fraction and a second portion for the heavy oil fraction;

hydrocracking the portion for the light oil fraction in a second hydrocracking step under a second hydrocracking regime, to form a second light oil hydrocrackate with a boiling range suitable for the light oil fraction, combining the hydrocrackate portion for the heavy oil and the second light oil hydrocrackate to form a combined hydrocrackate, processing the combined hydrocrackate to meet product specifications for the light oil lube fraction and the heavy oil lube fraction and form a combined stream of a finished light oil lube fraction and a finished heavy oil lube fraction, and fractionating the combined stream to separate the finished light oil lube fraction and the finished heavy oil lube fraction; wherein the first hydrocrackate and the combined stream are fractionated to form the finished light oil lube fraction and the finished heavy oil lube fraction in a common divided wall fractionator.

16. A process according to claim 15 in which the first hydrocrackate is separated into the first portion for the light oil fraction and the second portion for the heavy oil fraction in one section of the divided wall fractionator on one side of the divided wall and the combined stream is fractionated on the other side of the divided wall.

* * * * *